United States Patent [19]

Fieser et al.

[11] 4,101,328

[45] Jul. 18, 1978

[54] WHITE RUST INHIBITOR

[75] Inventors: Arthur H. Fieser, Wexford; Donald C. Finney, Bellevue, both of Pa.

[73] Assignee: A. F. Industries, Inc., Pittsburgh, Pa.

[21] Appl. No.: 703,848

[22] Filed: Jul. 9, 1976

[51] Int. Cl.[2] ..... C09D 5/08

[52] U.S. Cl. ..... 428/624; 21/2.5 B; 252/390; 252/394; 252/396; 106/14.18; 252/390;394;396

[58] Field of Search ..... 106/14; 427/433; 148/6.14 R; 428/457; 21/2.5 B

[56] References Cited

U.S. PATENT DOCUMENTS

| | | | |
|---|---|---|---|
| 2,837,432 | 6/1958 | Drigot et al. | 106/14 |
| 3,371,047 | 2/1968 | Brunel | 148/6.14 R |
| 3,749,598 | 7/1973 | Kushima et al. | 148/6.14 R |

*Primary Examiner*—Lorenzo B. Hayes

*Attorney, Agent, or Firm*—Robert D. Yeager

[57] ABSTRACT

A white rust inhibited composition is comprised of a zinc containing substrate. A white rust inhibiting composition contacts the substrate and is comprised of a vapor corrosion inhibitor and a pH adjusting compound to adjust and maintain the pH of the white rust inhibiting composition between 8 and 12.5.

4 Claims, No Drawings

WHITE RUST INHIBITOR

BACKGROUND OF THE INVENTION

1. Field of the Invention

This invention relates to corrosion inhibition and more particularly to the inhibition of the formation of white rust on galvanized steel.

2. Description of the Prior Art

Galvanized steel is extensively used in the form of flat rolled sheet and strip, rod, wire, fasteners and the like where protection against corrosion for steel articles having a light section are utilized. The steel provides the strength to the article while the zinc coating on the steel provides corrosion protection.

When used herein "galvanized steel" means steel coated with zinc by hot-dip sheet galvanizing, continuous (strip) hot-dip galvanizing, and electro-galvanizing. Galvanized steel is comprised of a steel substrate coated with zinc. The galvanized steel has three different layers, the steel, steel zinc alloys or mixtures, and zinc. In the processes for producing galvanized steel, the steel is coated with zinc and an inorganic coating, usually containing hexavalent chromium, is applied to the finished galvanized steel. Illustrative of such chromium coatings are those of the type disclosed in U.S. Pat. No. 3,620,777. The hexavalent chromium coating is used, in part, to prevent the formation of "white rust" which is the corrosion product of zinc. As used herein "white rust" is synonymous with "wet storage stain" which in the majority of instances, is white in color. However, under certain conditions, black and other colored chromium products may be encountered. Although the chromium coating provides some protection to the zinc, galvanized steel which is stored for even short periods of time develops white rust and thus becomes undesirable for the particular end use. Further, hexavalent chromium compounds have been questioned as potential health hazards and the steel industry has actively been engaged in pursuing methods of preventing white rust while eliminating the need for chromate coatings.

In accordance with the present invention, a method and composition are provided for the inhibition of white rust.

SUMMARY OF THE INVENTION

A composition for the prevention of white rust is comprised of a corrosion inhibitor adjusted and maintained at a pH of 8 to 12.5 and preferably 10 to 12.5.

The corrosion inhibitors useful in the practice of the invention are salts of an acid and an amine which are normally characterized as vapor corrosion inhibitors and are known to those skilled in the art.

Illustrative of the acids useful in forming the corrosion inhibiting salts are, but not limited to, the carboxylic acids such as:

carbonic acid
myristic acid
butyric acid
palmitic acid
valeric acid
stearic acid
caproic acid
2-ethyl hexanoic acid
caprylic acid
oleic acid
capric acid
linoleic acid
pelargonic acid
linolenic acid
lauric acid
versatic acid
cyclohexane carboxylic acid
nitrobenzoic acid
phenyl acetic acid
phthalic acid
benzoic acid
salicylic acid
toluic acid
succinic acid
chlorobenzoic acid
glutaric acid and the like. Also inorganic acids such as nitric acid and boric acid may be used in forming the amine salts.

The amines useful in forming the corrosion inhibiting salts are, but not limited to:

ethyl amine
β-phenyl ethyl amine
diethyl amine
diethanol amine
n-propyl amine
dimethyl ethanol amine
di-n-propyl amine
morpholine
isopropyl amine
aniline
n-butyl amine
methyl aniline
isobutyl amine
dimethyl aniline
sec-butyl amine
diphenyl amine
cyclohexyl amine
ethylene diamine
α-phenyl ethyl amine
hexamethylene diamine and the like and polyamines such as those having the structural formula $RNHXR'NH_2$ wherein R is an aliphatic hydrocarbon radical having 10 to 20 carbon atoms, N is nitrogen, X is selected from the group consisting of R, H, and R'NHY, R' is a hydrocarbon radical containing from 2 to 4 carbon atoms, H is hydrogen and Y is selected from the group consisting of H and R.

Although virtually any combination of the above-recited amines and acids may be used to form the corrosion inhibiting salts, care must be taken that the proper vehicle be used to both mix and apply the corrosion inhibiting composition to the galvanized steel substrate. For example, if benzoic acid is to be used to form the carboxylate ion, a solvent such as the cellosolves® must be provided as a vehicle to cause the mixture to be homogeneous. Whereas, a salt such as dicyclohexyl ammonium pelargonate is soluble in a variety of vehicles such as water, mineral oil and the like.

It has been found that the following corrosion inhibitors are particularly useful in the practice of the invention: dicyclohexyl ammonium nitrate, dicyclohexyl ammonium pelargonate, morpholine carbonate, dicyclohexyl ammonium carbonate, amyl ammonium caprate, cyclohexyl ammonium 2-ethyl hexanoate, cyclohexyl ammonium pelargonate, dicyclohexyl ammonium caprylate, dicyclohexyl ammonium caproate, dicyclohexyl ammonium 2-ethyl hexanoate, morpholine caprylate, morpholine caprate, diethanol ammonium borate, diethanol ammonium pelargonate, diethyl ammonium caprylate and morpholine octoate.

The corrosion inhibiting salt may be prepared by methods known to those skilled in the art. For example, stoichiometric quantities of the acid and the amine may be sequentially added to a suitable solvent such as water, mineral oil, cellosolve® or the like and agitated until salt formation is complete. When higher molecular weight acids and amines or when aromatic acids and amines are used to form the salt, the solvent and salt constituents may be heated to insure a homogeneous solution.

In preparing a white rust inhibiting composition in accordance with the invention, the corrosion inhibiting salt is first formed or dissolved in a suitable vehicle for application to the galvanized steel surface. Vehicle selection is based on the solubility characteristics of the corrosion inhibiting salt which is selected. Some suitable solvents are, but not limited to, refined mineral oil, grease, kerosene, water, cellosolves®, methanol, 2-ethylhexanol, ethanol, isopropanol, methyl acetate, p-dioxane, dimethyl formamide, waxes both natural and synthetic including the polyglycols having a molecular weight greater than 1000, and the like.

After formation of a solution of the salt in the particular vehicle, the effective pH of the solution is adjusted between 8 and 12.5 and preferably 10 to 12.5 by the addition of an appropriate amount of a base having a pK of less than 5 and more preferably less than 4. Sufficient pH adjuster shoulder be added to maintain the pH in the desired range to account for any changes in the composition over time which would tend to lower the pH below the desired range. Thus an excess of pH adjuster may be added to enable the white rust inhibiting composition to have a longer effective life. Exemplary of the bases are amines such as:

aminoethyl alcohol
sec-butyl amine
n-amyl amine
tert-butyl amine
iso-amyl amine
cyclohexyl amine
benzyl amine
diethyl amine
benzyl pyrrolidine
diisobutyl amine
n-butyl amine
diethanol amine
isc-butyl amine
sec-butyl amine
tert-butyl amine
cyclohexyl amine
diethyl amine
diisobutyl amine
diethanol amine
diisopropyl amine
dimethyl amine
ethyl amine
ethylene diamine
methyl amine
methyl diethyl amine
n-methyl pyrrolidine
nitroaniline
isopropyl amine
triethyl amine The pK of 5 and preferably less than 4 is desired to enable small amounts of amine which are added to the corrosion inhibiting salt solution to adjust and maintain the pH to the level of 8 to 12.5 and preferably 10 to 12.5. Selection of the particular amine for pH adjustment is based on certain constraints relative to desired properties of the final white rust inhibiting composition. Longer effectiveness against white rust can be obtained by selecting an amine to adjust the pH which has low volatility, for example cyclohexyl amine has been found to be extremely effective in adjusting and maintaining the pH of the final solution. The lower alkyl amines such as methyl amine, dimethyl amine, ethyl amine and the like will find minimum utility and will only be used in systems where short term protection against white rust is desired.

The term "effective pH" as used herein means the pH of an 0.5 percent aqueous solution of the corrosion inhibiting and pH adjusting constituents of the composition whether such constituents are finally used in an aqueous or non-aqueous vehicle.

In addition to the above-mentioned constituents of the white rust inhibiting composition, other ingredients may be added to provide the proper application properties to the final composition. For example, surface active agents, preferably nonionic may be used to increase the wetting characteristics of the composition on the galvanized steel. Typical nonionic surfactants are, but not limited to, sorbatan monooleate, the alkoxypolyalkylene gylcols, such as methoxy poly(oxyethylene 300) glycol, and the like.

The white rust inhibiting composition may be applied to the galvanized steel by a plurality of methods. A preferred method of application for the composition to galvanized steel when the vehicle is a mineral oil is by spraying, brushing, roll coating, squegging or a like method. A minimum film thickness of the composition is about 0.1 mils of a solution having about 0.25 to 20 percent by weight of the corrosion inhibiting salt therein with a preferred film thickness of 0.25 to 0.50 mils of a solution having 5 to 10 percent by weight of the corrosion inhibiting salt therein.

Another convenient method of application of the composition to galvanized steel is by impregnating paper with the composition and interleaving the impregnated paper within the sheets or within the coil of the galvanized steel. The paper may be impregnated with a white rust inhibiting composition by soaking the paper with a composition which uses a volatile solvent as a vehicle or by impregnating the paper with a composition whic uses a wax, oil or similar material as a vehicle.

When the galvanized steel is stored at the steel mill or warehoused in bulk, white rust can be prevented by storing the galvanized steel under water in ponds containing about 0.25 to 5 percent by weight of the corrosion inhibiting salt with the pH of the solution adjusted and maintained to 8 to 12.5 and preferably 10 to 12.5.

In addition to galvanized steel, other zinc surfaced steels may be protected from white rust by the composition of the invention. For example, galvannealed coils and sheets may be treated in the manner previously described. Further, zinc metal itself may be protected from white rust by the compositions of the invention. When used herein "zinc surfaced steels" include both galvanized steel and galvannealed steel.

The following examples are presented to demonstrate several embodiments of the present invention and are not intended as limitations thereon.

EXAMPLE I

To a suitably sized vessel was charged 40 grams of refined mineral oil having a viscosity of 340 centipoise, 0.1 g. of Span® 80 (sorbatan monooleate), 2.8 g. dicyclohexyl ammonium pelargonate and 1.4 g. of cyclohexyl amine. Each ingredient was charged sequentially with agitation when the previous ingredient appeared to be dissolved. The composition had an effective pH of 10.5 at 25° C.

Three galvanized steel coupons each 2 in.$^2$ were coated with the above composition by wiping a saturated cotton swab on the galvanized steel surface. Three drops of water were placed on the surface of one coupon equidistant to each other and a second coupon was placed thereon. Water was applied as previously described to the second coupon and the third coupon was placed on the second. The stack was allowed to age at ambient temperature (65°-75° F) and was disassembled evey 24 hrs. to inspect for white rust formation. After inspection, the samples would be re-wet as hereinbefore described and reassembled for further testing. The results of Example I along with Examples II-IX are reported in Table I.

EXAMPLE II

The following ingredients were combined and tested in accordance with the procedure of Example I:

35 g. refined mineral oil (340 cps)
0.1 g. Span® 80
5 g. Stoddard solvent
2 g. dicyclohexyl ammonium pelargonate 0.5 g. cyclohexyl amine
Effective pH 10.5

EXAMPLE III

The following ingredients were combined and tested in accordance with the procedure of Example I:

24.5 g. refined mineral oil (340 cps)
0.03 g. Span® 80
16.6 g. Stoddard solvent
2.0 g. dicyclohexyl ammonium pelargonate
0.03 g. cyclohexyl amine
Effective pH 10.5

EXAMPLE IV

Control - Chromate treated galvanized steel was coated with mineral oil and tested in accordance with the procedure of Example I.

EXAMPLE V

The following ingredients were combined and tested in accordance with Example I:

50 g. refined mineral oil (340 cps)
0.05 g. Span® 80
3.2 g. dicyclohexyl ammonium caprylate
0.5 g. cyclohexyl amine
(Ingredients heated to 150° F until homogeneous)
Effective pH 10.5

EXAMPLE VI

The following ingredients were combined and tested in accordance with Example V:

40 g. refined mineral oil (340 cps)
0.05 g. Span® 80
1.6 g. dicyclohexyl ammonium pelargonate
0.3 g. cyclohexyl amine
Effective pH 10.5

EXAMPLE VII

The following ingredients were combined and tested in accordance with Example V:

40 g. refined mineral oil (340 cps)
0.05 g. Span® 80
1.6 g. diethanol ammonium caprylate
0.3 g. cyclohexyl amine
Effective pH 10

EXAMPLE VIII

The following ingredients were combined and tested in accordance with Example V:

40 g. refined mineral oil (340 cps)
0.05 g. Span® 80
0.8 g. diethanol ammonium borate
0.3 g. cyclohexyl amine

EXAMPLE IX

Control - Untreated galvanized steel was tested in accordance with the procedure of Example I.

TABLE I

| Example Number | Corrision Inhibitor | pH Adjuster | Effective pH | Vehicle | White Rust Formation Based On Internal Stacked Surface Area After 1 Week | 2 Weeks | 3 Weeks | 4 Weeks |
|---|---|---|---|---|---|---|---|---|
| I | dicyclohexyl ammonium pelargonate | cyclohexyl amine | 10.5 | oil | 0 | 0 | 0 | 25% |
| II | dicyclohexyl ammonium pelargonate | cyclohexyl amine | 10.5 | oil and Stoddard solvent | 0 | 0 | 0 | 0 |
| III | dicyclohexyl ammonium pelargonate | cyclohexyl amine | 10.5 | oil and Stoddard solvent | 0 | 5% | 15% | 35% |
| IV | control | — | — | oil | 10% | — | — | 90% |
| V | dicyclohexyl ammonium caprylate | cyclohexyl amine | 10.5 | oil | 0 | 0 | — | — |
| VI | dicyclohexyl ammonium pelargonate | cyclohexyl amine | 10.5 | oil | 0 | 0 | — | — |
| VII | diethanol ammonium caprylate | cyclohexyl amine | 10 | oil | 0 | 0 | — | — |
| VIII | diethanol ammonium borate | cyclohexyl amine | 10 | oil | 0[1] | 0 | — | — |
| IX | control | — | — | none | 90%[2] | — | — | — |

[1]A white precipitate formed on the steel surface and appeared to be salt crystals (was not white rust).
[2]Began to form white rust within 24 hrs.

As is illustrated by the examples hereinbefore set forth, the white rust inhibiting compositions of the invention are far superior to chromate treatments for galvanized steel.

It is hypothesized that the vapor corrosion inhibitor protects the steel and iron portion of the iron zinc alloy against regular rusting and corrosion and the pH adjustment and maintenance provides protection to the zinc and zinc portion of the iron zinc alloy. Further, it is hypothesized that an excess of pH adjuster preserves the composition from pH reduction due to normal atmospheric conditions. In all of the above examples not only was the zinc inhibited from white rusting, but also the steel did not corrode during the stack test.

What is claimed is:

1. In a combination including a zinc surfaced steel substrate susceptible to white rust and an amine-acid salt corrosion inhibiting composition in contact with the substrate, the improvement comprising:

an effective amount of a pH adjusting amine, having a pK of less than 5, to adjust the effective pH of said corrosion inhibiting composition at 8 to 12.5

2. The combination of claim 1 wherein said pH adjusting amine has a pK of less than 4.

3. The combination of claim 1 wherein said pH adjusting amine is cyclohexyl amine.

4. The combination of claim 1 wherein the effective pH of said corrosion inhibiting composition is 10 to 12.5.

* * * * *

UNITED STATES PATENT AND TRADEMARK OFFICE

CERTIFICATE OF CORRECTION

PATENT NO. : 4,101,328

DATED : July 18, 1978

INVENTOR(S) : Arthur H. Fieser and Donald C. Finney

It is certified that error appears in the above-identified patent and that said Letters Patent are hereby corrected as shown below:

Column 3, line 31, "shoulder" should read --should--; line 50, "isc-butyl amine" should read --iso-butyl amine; line 51 through and including line 56 should be deleted.

Column 4, line 50, "whic" should read --which--.

Signed and Sealed this

*Twenty-third* Day of *January 1979*

[SEAL]

*Attest:*

RUTH C. MASON
*Attesting Officer*

DONALD W. BANNER
*Commissioner of Patents and Trademarks*